US006595518B2

(12) United States Patent
Dobrindt

(10) Patent No.: US 6,595,518 B2
(45) Date of Patent: Jul. 22, 2003

(54) THREE-WAY DIVERTER

(75) Inventor: Dirk Dobrindt, Klausdorf/Schwentine (DE)

(73) Assignee: Nexpress Solutions LLC, Rochester, NY (US)

( * ) Notice: Subject to any disclaimer, the term of this patent is extended or adjusted under 35 U.S.C. 154(b) by 13 days.

(21) Appl. No.: 10/016,092

(22) Filed: Dec. 6, 2001

(65) Prior Publication Data

US 2002/0074722 A1 Jun. 20, 2002

Related U.S. Application Data

(60) Provisional application No. 60/283,399, filed on Apr. 12, 2001.

(30) Foreign Application Priority Data

Apr. 14, 2000 (DE) ..... 200 06 890

(51) Int. Cl.[7] ..... B65H 39/10
(52) U.S. Cl. ..... 271/303
(58) Field of Search ..... 271/303; B65H 39/10

(56) References Cited

U.S. PATENT DOCUMENTS 5,794,931 A * 8/1998 Heilman et al. ..... 271/303
5,868,387 A * 2/1999 Kida et al. ..... 271/304
6,176,485 B1 * 1/2001 Wingate ..... 271/303

FOREIGN PATENT DOCUMENTS

JP 57-203648 * 12/1982 ..... B65H/29/60

* cited by examiner

*Primary Examiner*—Donald P. Walsh
*Assistant Examiner*—Kenneth W Bower
(74) *Attorney, Agent, or Firm*—Lawrence P. Kessler

(57) ABSTRACT

A three-way diverter having two paper guide elements which, in the area of the fork in the paper running paths, are pivotably arranged upstream of the dividing points of the paper running paths in such a way that, in a first position, they connect the access to the central outlet and, as a result of one of the paper guide elements in each case being pivoted into a second or third position, one of the outer outlets for the paper run is opened and the other outlets are blocked. The access has a funnel-like taper in the paper running direction and, downstream of the taper of the access, there are on both sides depressions which are sufficiently large that, in the second or third position, they accommodate both leading ends of the paper guide elements such that the latter lie to one side of the paper run.

5 Claims, 1 Drawing Sheet

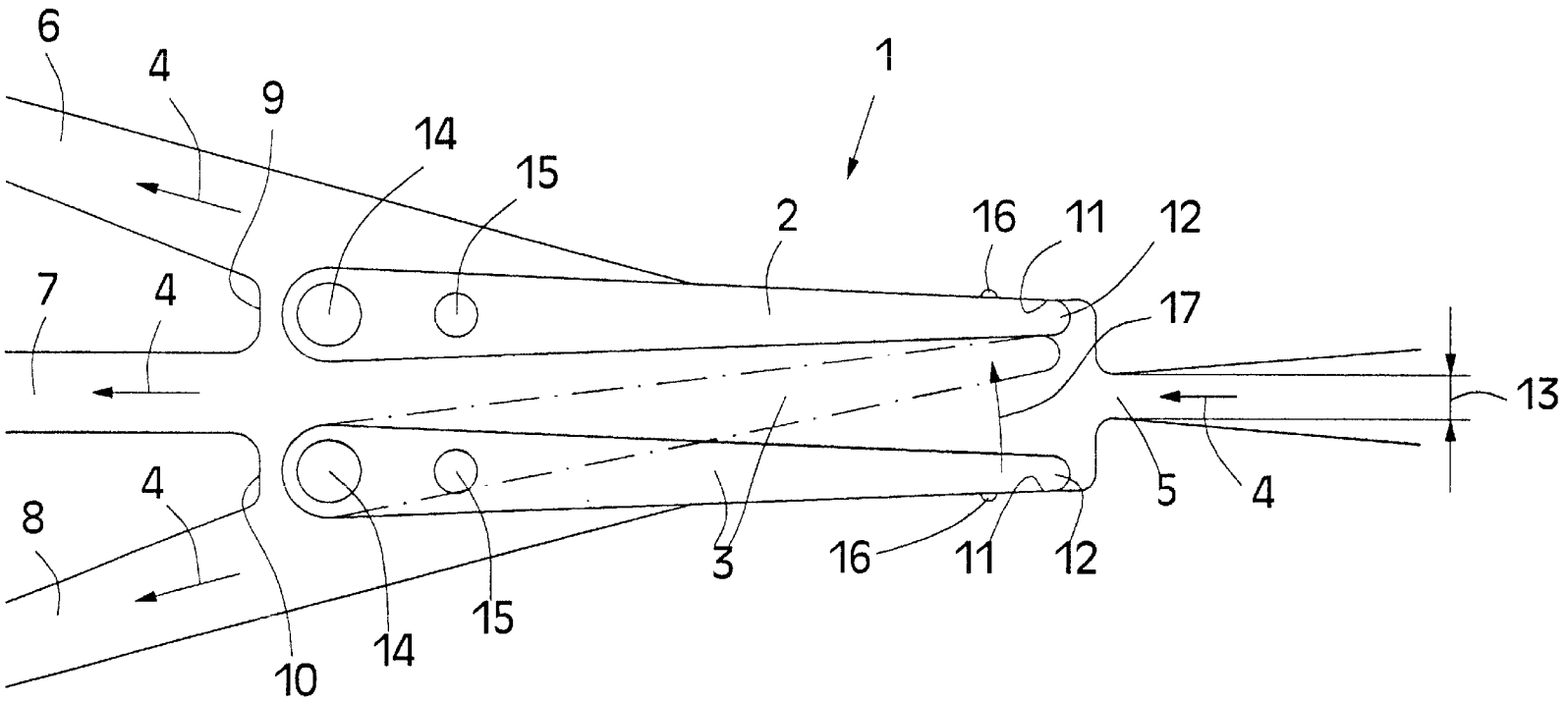
1
2
3
4
4
4
5
6
7
8
9
10
11
11
12
12
13
14
14
15
15
16
16
17

THREE-WAY DIVERTER

This application claims the benefit of Provisional Application No. 60/283,399, filed Apr. 12, 2001.

FIELD OF THE INVENTION

The invention relates to a three-way diverter having two paper guide elements which, in the area of the fork in the paper running paths, are pivotably arranged upstream of the dividing points of the paper running paths in such a way that, in a first position, they connect the access to the central outlet and, as a result of one of the paper guide elements in each case being pivoted into a second or third position, one of the outer outlets for the paper run is opened and the other outlets are blocked.

BACKGROUND OF THE INVENTION

A three-way diverter is disclosed by DE-A 1 499 553. In the case of this three-way diverter, the switching travel and therefore the switching time is too long for specific applications.

SUMMARY OF THE INVENTION

The invention is therefore based on the object of shortening the switching time of a three-way diverter.

According to the invention, the object is achieved by the access having a funnel-like taper in the paper running direction and, downstream of the taper in the access, there being on both sides depressions which are sufficiently large that, in the second or third position, they accommodate both leading ends of the paper guide elements in such a way that the latter lie to one side of the paper run.

The invention achieves a not inconsiderable shortening of the switching travel and therefore the switching time, which is relevant to all applications in which a long switching path hampers the achievement of a faster machine run. For this reason, installing the three-way diverter according to the invention in the paper run in a printing machine with digital image generation has proven to be very expedient. The most far-reaching reduction in the switching travel and therefore the switching time can be achieved by the access having a height which exceeds the maximum thickness of papers to be processed by the amount required for smooth-running guidance of these papers.

One expedient refinement provides for each paper guide element to be assigned a sensor for position interrogation. By arranging the two sensors, it is possible to determine which of the three possible paths is open.

Provision is advantageously made for the actuating elements for the paper guide elements to be designed in such a way that they are in the rest position when in the position in which the most used outlet is open. As a result, in the case of current-operated actuating elements, for example in the case of solenoids, current can be saved and there is always a defined position in the event of a power outage.

BRIEF DESCRIPTION OF THE DRAWING

The invention will be explained below using an exemplary embodiment illustrated in the drawing. The FIGURE shows a three-way diverter 1 having two paper guide elements 2, 3 which, by means of mountings 14, are arranged at the dividing points 9, 10 of the paper running paths 6 and 7 and also 7 and 8.

DETAILED DESCRIPTION OF THE PREFERRED EMBODIMENTS

In the representation by means of continuous lines, in each case a leading end 12 of a paper guide element 2, 3 lies in one of two depressions 11 arranged on both sides. In this position, the access 5 is connected to the central outlet 7. If a paper guide element 2, 3 is pivoted, then the access 5 is connected to one of the paper running paths 6 or 8. Represented by dash-dotted lines is the pivoting (arrow 17) of the paper guide element 3 into a position such that the access 5 is connected to the outlet 8. The depressions 11 have a depth such that the leading ends 12 of the paper guide elements 2, 3 lie outside the paper run, represented by arrows 4, even in the last named position. The actuating movements 17 are carried out by actuating elements (not illustrated) which are operatively connected to the paper guide elements 2, 3 at the articulations 15.

The invention provides for the actuating travel of the paper guide elements 2, 3 to be reduced in that the access 5 has a funnel-like taper in the paper running direction 4 and, downstream of this taper of the access 5, the depressions 11 for accommodating the leading ends 12 of the paper guide elements 2, 3 are arranged. In this case, the largest saving in actuating travel, and therefore the greatest shortening of the switching time, is achieved when the access 5 has a height 13 which is dimensioned such that it exceeds the maximum thickness of papers to be processed to such an extent that smooth-running and therefore fast guidance of the same is still ensured.

The paper guide elements 2, 3 are expediently located in the rest position when in a position in which they connect the access 5 to the outlet which is used most frequently; this may be the outlet 7 or one of the other two outlets 6 or 8. In this rest position, actuating elements designed as electromagnets, for example, are non-energized, and the paper guide elements 2, 3 are held in the rest position by springs (not illustrated).

By means of two sensors 16, the positions of the two paper guide elements 2, 3 may be registered. For example, the sensors 16 can be arranged in such a way that they register the contact in the depressions 11. Of course, any other arrangement is likewise conceivable. The essential factor is that the connection of the access 5 to one of the three outlets 6, 7 or 8 can be registered by means of two sensors. Of course, the positions can also be determined by its being registered whether the actuating elements, for example electromagnets, are energized or not.

Parts List

| | |
|---|---|
| 1 | Three-way diverter |
| 2, 3 | Paper guide elements |
| 4 | Arrow: paper run |
| 5, 6, 7, 8 | Paper running paths |
| 5 | Access |
| 6, 7, 8 | Outlets |
| 7 | Central outlet |
| 9, 10 | Dividing points of the paper running paths |
| 11 | Depressions |
| 12 | Leading ends of the paper guide elements |
| 13 | Height of the access |
| 14 | Mountings of the paper guide elements |
| 15 | Articulations of actuating elements |
| 16 | Sensors |
| 17 | Arrow: pivoting one of the paper guide elements |

What is claimed is:

1. A three-way diverter (1) having two paper guide elements (2, 3) which, in the area of the fork in the paper running paths (5, 6, 7, 8), are pivotably arranged upstream of the dividing points (9, 10) of the paper running paths (6 and 7, 7 and 8) in such a way that, in a first position, they connect the access (5) to the central outlet (7) and, as a result of one of the paper guide elements (2 or 3) in each case being pivoted into a second or third position, one of the outer outlets (6 or 8) for the paper run (4) is opened and the other outlets (7 and 8 or 6) are blocked, wherein the access (5) has stationary walls in the paper running direction (4) and, downstream of the access (5), there are on both sides depressions (11) which are sufficiently large that, in the second or third position, they accommodate both leading ends (12) of the paper guide elements (2, 3) in such a way that the latter lie to one side of the paper run (4).

2. The three-way diverter as claimed in claim 1, wherein the access (5) has a height (13) which exceeds the maximum thickness of papers to be processed by the amount required for smooth-running guidance of these papers.

3. The three-way diverter as claimed in claim 1, wherein each paper guide element (2, 3) is assigned a sensor (16) for position interrogation.

4. The three-way diverter as claimed in claim 3, wherein the actuating elements for the paper guide elements (2, 3) are in the rest position when in the position in which the most used outlet (6, 7 or 8) is open.

5. The three-way diverter as claimed in claim 1, wherein it is installed in the paper run (4) in a printing machine with digital image generation.

* * * * *